US005393167A

United States Patent [19]

Fujita et al.

[11] Patent Number: 5,393,167

[45] Date of Patent: Feb. 28, 1995

[54] METHOD FOR CONTROLLING THE THICKNESS OF PAVEMENT AND SETTING THE CONDITIONS FOR AUTOMATIC CONTROL OF THE LEVELING MACHINE

[75] Inventors: Makio Fujita; Fumio Goto; Tetsuo Ogawa; Akio Ishii, all of Gunma; Tomohiro Gocho, Tokyo; Narimasa Yamabe, Tokyo; Ichiro Miyazaki, Tokyo; Masaaki Saito, Yokohama; Yoshihiro Sasa, Gunma, all of Japan

[73] Assignees: Niigata Engineering Co., Ltd.; Nippon Hodo Co., Ltd., both of Tokyo, Japan

[21] Appl. No.: 138,828

[22] Filed: Oct. 18, 1993

Related U.S. Application Data

[63] Continuation of Ser. No. 838,720, Mar. 16, 1992, abandoned.

[30] Foreign Application Priority Data

Nov. 14, 1990 [JP] Japan ..... 2-307582
Nov. 14, 1990 [JP] Japan ..... 2-307588

[51] Int. Cl.[6] ..... E01C 19/00
[52] U.S. Cl. ..... 404/84.1; 404/118
[58] Field of Search ..... 404/84.1, 84.2, 118

[56] References Cited

U.S. PATENT DOCUMENTS 4,988,233 1/1991 Kasler et al. ..... 404/84.1 X
5,044,820 9/1991 Prang ..... 404/84.1
5,328,295 7/1994 Allen ..... 404/84.1

*Primary Examiner*—William P. Neuder
*Attorney, Agent, or Firm*—Darby & Darby

[57] ABSTRACT

A measuring arm (12) is attached to a frame (5a) supporting a screed (5). Height sensors (13) and (14) are attached to the measuring arm (12), and a height sensor (19) is also attached to the arm (18) of the screed (5). The spacing must remain constant between the rear end of the screed (5) and the height sensor (19), between the height sensor (19) and the height sensor (14), and between the height sensor (14) and the height sensor (13). A distance sensor to calculate the travel distance is provided on the tractor unit (1). The relative height Ho of both height sensors (13) and (14) to the screed (5) must always remain constant, regardless of the tilt of the screed (5) and the measuring arm (12). The sensors (13), and (14), and (17) are connected to the arithmetic unit (30). The height sensor (19) is connected to the arithmetic unit (40). The arithmetic unit (30) receives an output signal from the height sensors (13) and (14) and calculates the thickness of the pavement. The arithmetic unit (40) detects the uneven level of the unpaved surface on the basis of the output signal from the height sensor (19) and controls the screed (5) in order to offset the unevenness.

The operating conditions are set on the control unit (30) via a recording medium such as an IC card.

5 Claims, 9 Drawing Sheets

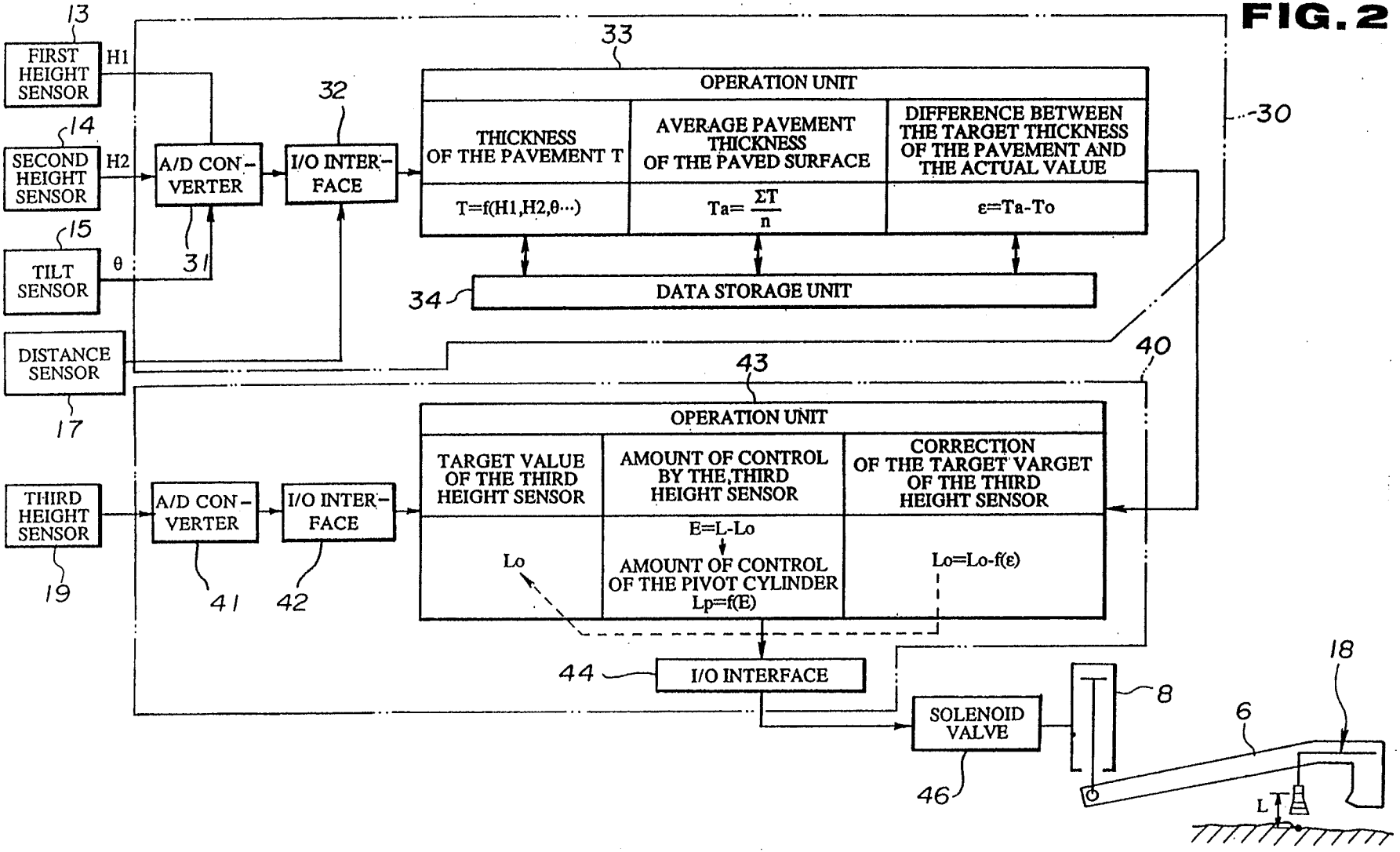
FIG. 2
30
33
OPERATION UNIT
THICKNESS OF THE PAVEMENT T
T=f(H1,H2,θ...)
AVERAGE PAVEMENT THICKNESS OF THE PAVED SURFACE
Ta= ΣT/n
DIFFERENCE BETWEEN THE TARGET THICKNESS OF THE PAVEMENT AND THE ACTUAL VALUE
ε=Ta-To
DATA STORAGE UNIT
34
40
43
OPERATION UNIT
TARGET VALUE OF THE THIRD HEIGHT SENSOR
Lo
AMOUNT OF CONTROL BY THE THIRD HEIGHT SENSOR
E=L-Lo
AMOUNT OF CONTROL OF THE PIVOT CYLINDER
Lp=f(E)
CORRECTION OF THE TARGET VARGET OF THE THIRD HEIGHT SENSOR
Lo=Lo-f(ε)
I/O INTERFACE
44
SOLENOID VALVE
46
8
6
18
L
T
32
I/O INTER-FACE
A/D CON-VERTER
31
42
I/O INTER-FACE
A/D CON-VERTER
41
H1
H2
θ
13
FIRST HEIGHT SENSOR
14
SECOND HEIGHT SENSOR
15
TILT SENSOR
DISTANCE SENSOR
17
THIRD HEIGHT SENSOR
19

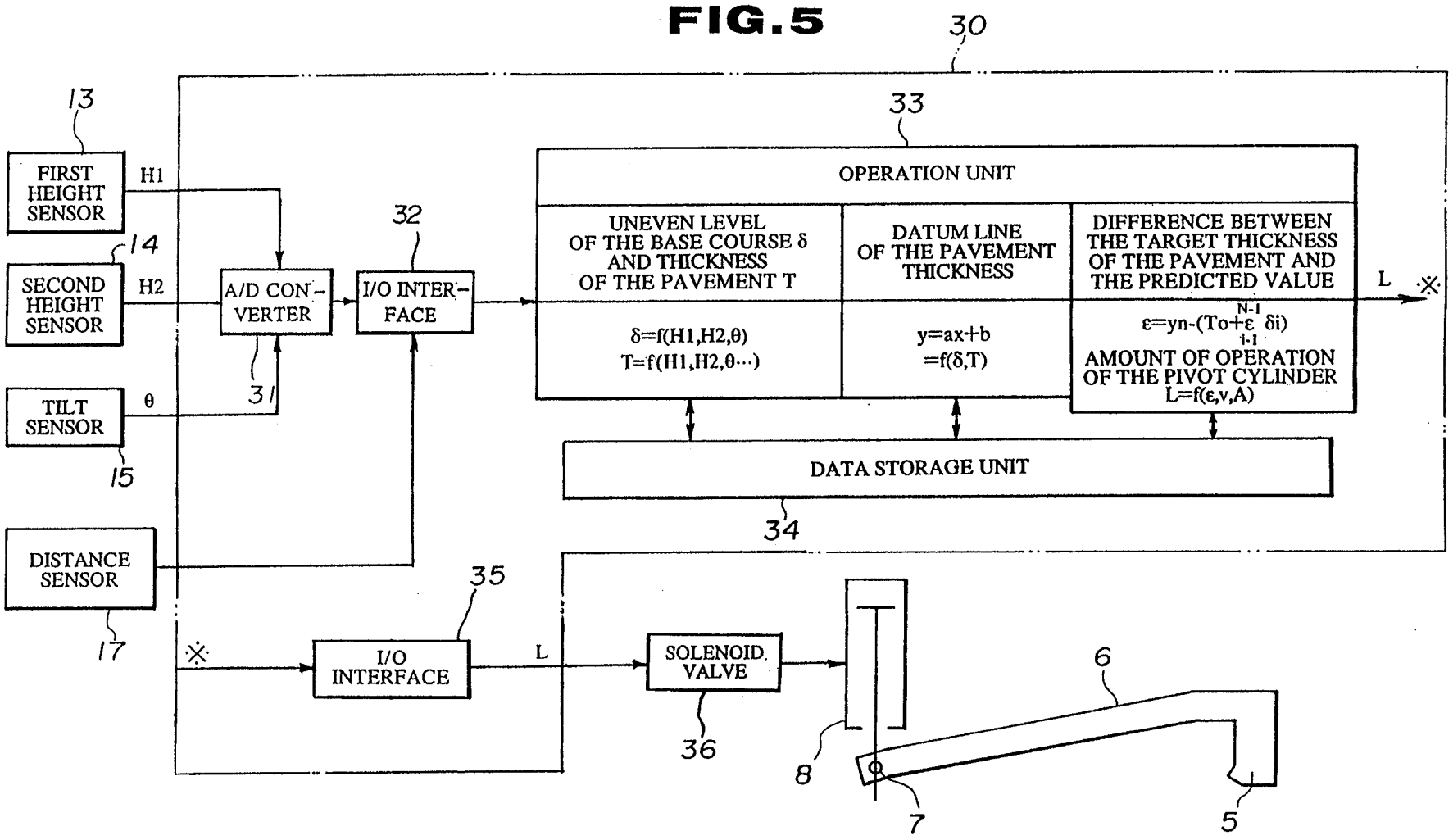
FIG. 5
30
33
OPERATION UNIT
UNEVEN LEVEL OF THE BASE COURSE δ AND THICKNESS OF THE PAVEMENT T
δ=f(H1,H2,θ)
T=f(H1,H2,θ...)
DATUM LINE OF THE PAVEMENT THICKNESS
y=ax+b
=f(δ,T)
DIFFERENCE BETWEEN THE TARGET THICKNESS OF THE PAVEMENT AND THE PREDICTED VALUE
ε=yn-(To+Σ δi)
AMOUNT OF OPERATION OF THE PIVOT CYLINDER
L=f(ε,v,A)
L
DATA STORAGE UNIT
34
I/O INTER-FACE
32
A/D CON-VERTER
31
H1
H2
θ
FIRST HEIGHT SENSOR
13
SECOND HEIGHT SENSOR
14
TILT SENSOR
15
DISTANCE SENSOR
17
I/O INTERFACE
35
SOLENOID VALVE
36
5
6
7
8

$\delta_1 = H_2 - (H_1 - M\tan\theta_1)$ $\delta_2 = H_{22} - (H_{21} - M\tan\theta_2)$ $T = H_{32} - (\delta_1 + \delta_2) - 2M\tan\theta_3 - H_0$

FIG.12

38

ENTER THE INITIAL CONDITIONS : INSERT THE CARD

| | | | |
|---|---|---|---|
| · METHOD FOR CONTROLLING THE THICKNESS OF THE PAVEMENT | : | 1. PAVEMENT THICKNESS PRIORITY | 2. FLATNESS PRIORITY |
| | | 3. SIDE LEVEL | 4. SLOPE LEVEL |
| · TYPE OF MIXED MATERIAL | : | 1. COARSE-GRADED ASPHALT CONCRETE (20) | 2. DENSE-GRADED ASPHALT CONCRETE (20) |
| · WIDTH OF THE PAVEMENT | : | □.□ m | |
| · THICKNESS OF THE PAVEMENT : LEFT | : | □.□ mm | RIGHT : □.□ mm |
| · PLANNED LENGTH OF THE PAVEMENT | : | □□□ m | |
| · PLANNED WORKING SPEED | : | □.□ m/min | |
| · DENSITY OF THE MIXED MATERIAL | : | □.□□ $t/m^3$ | |

IC CARD OK (OR NOT)

METHOD FOR CONTROLLING THE THICKNESS OF PAVEMENT AND SETTING THE CONDITIONS FOR AUTOMATIC CONTROL OF THE LEVELING MACHINE

This is a continuation of application Ser. No. 07/838,720, filed Mar. 16, 1992, now abandoned.

TECHNICAL FIELD

This invention relates to a method for controlling the thickness of pavement and setting the automatic control conditions used for leveling machines such as the asphalt finisher and the base paver.

BACKGROUND TECHNOLOGY

In general, a paved road must be finished to a level surface.

One current method for finishing the paved surface of the road and making it level requires using curbstones or the gutter on the edge of the road as the reference plane (or line) according to which the paved surface can be finished.

Another method for finishing the paved surface of the road requires a use of an averaging beam (about as long as the tractor unit) which is placed along the side of a tractor unit in the travelling direction and by considering the unpaved surface of the road as a approximately flat.

To operate such conventional leveling machines, the operator must have knowledge of the pavement conditions including the type of mixed asphalt material to be used, the pavement width, and the pavement thickness. Moreover, the operator must run the machine while watching the actual surface to be paved.

Regarding the former method of using curbstones for the reference plane, curbstones are not always found on the edge of the road to be paved. Moreover, when curbstones are available for the reference plane, the flatness of the ground may be gradually degraded as the distance from the curbstones increases.

The latter method requires an averaging beam, involving the use of large equipment. With larger paving equipment, operations are difficult on narrower roads. The averaging beam can be used only after the base preparation has been completed to some degree to diminish unevenness. In spite, the averaging beam method cannot control the thickness of the pavement.

The conventional leveling machine depends on the operator's sense for operation. The operator's skill often affects the quality of leveling; it is, therefore, difficult to always achieve an excellent finish with the conventional leveling machine.

This new automatic leveling machine is designed to be automatically operated In accordance with the operating conditions such as the type of mixed asphalt material, pavement width, and pavement thickness. This information is entered into the control unit from the keyboard.

However, it is troublesome to enter such operating conditions into the control unit from the keyboard at the site. In addition, typing in data from the keyboard takes time and mistakes are very easy to make.

DISCLOSURE OF INVENTION

This invention was developed in consideration of the background described above. An object of the invention is to provide a method for setting the conditions of automatic control of the leveling machine, to control the pavement thickness without using large equipment such as an averaging beam.

It is another object of the present invention to provide a method for inputting the conditions of automatic control of the leveling machine into the control unit accurately and at a high speed.

To achieve the objects described above, the first invention has the following configuration.

In the method for controlling the thickness of the pavement with the leveling machine which controls the thickness of pavement leveled by a screed attached to the rear of the tractor unit freely tiltable forward and backward, a pair of height sensors which are attached to that leveling machine in the travelling direction with the specified spacing between them so as to tilt together with the screed measure the height of the unpaved surface when the leveling machine runs the same distance as the spacing between the height sensors, and the measured value is used to calculate the pavement thickness of the paved surface. Based on the output signal from the height sensors located in front of the screed, the uneven level of the unpaved surface is detected, and the screed is controlled to offset that uneven level, feeding back the difference between the thickness of pavement calculated above and the preset target thickness of the pavement.

This configuration ensures the flatness of the paved surface without requiring the use of any special device such as an averaging beam as described in the section on the conventional technology because the uneven level of the road surface is detected by height sensors located in front of the screed which is then controlled to offset any detected unevenness.

Because the thickness of the paved portion of the pavement is calculated and controlled on the basis of the output signal from a pair of height sensors, and of the difference between the calculated thickness of the pavement and the target thickness of the pavement, the thickness of the pavement will be close to the desired thickness.

The following is the configuration of the second invention.

The height of the paved surface of the road is measured at intervals of a specified distance in the travelling direction, and the measured values are used to create the datum line of the pavement thickness. The height of the unpaved surface is also measured, and this measured value is used to obtain the target level and the pavement thickness at the target point at the specified distance from the screed. Then, the target level compared with the datum line of the pavement thickness at the target point, and the screed is controlled to eliminate any difference.

In this configuration, the datum line to the pavement thickness achieved by measuring the paved surface indicates that paving the road with the screed tilted at the present angle will result in a finished surface at a very similar level as the datum line of the pavement thickness. The target thickness of the pavement at the target point represents the target value of the ideal thickness of the pavement.

Controlling the operation of the screed by comparing the calculated value and the target value to eliminate any difference between the two values at the target point at the specified point means that the road is being paved while controlling the screed so as to enable to achieve the desired thickness at the specified point.

When the tilt of the screed is changed, the thickness of the pavement does not immediately change; however, the result of changing the screed tilt appears at the point after the tractor unit travels over the specified distance. Therefore, controlling the screed in order to achieve the desired thickness of the pavement at the target point as described above is a method best-suited in cases where there is an actual need to provide pavement with a thickness close to the ideal value.

The method for controlling the screed mentioned above does not require any conventional averaging beam or other large-scale equipment.

The third invention has the following configuration.

The leveling machine which levels mixed asphalt under the operating conditions preset in the control unit, has a hopper which contains mixed asphalt material, a feeder which sends mixed asphalt material from the hopper to the screw, a screw which receives mixed asphalt material from the feeder and spreads it left and right, and a screed which levels the mixed asphalt material which has been spread by the screw mounted on the travelling tractor unit. The operating conditions are prerecorded on a medium such as the IC card in the control unit.

In the present configuration, the thickness of the pavement and other operating conditions are entered into a recording medium by a specialist in the office. Therefore, conditions can be written in quickly and accurately, with no errors.

The operator of the leveling machine simply insert the recording medium into the control unit, then starts the control unit to initiate the leveling work.

If any operating conditions are changed, the data on the recording medium is rewritten to include the new conditions. If the operating conditions remain unchanged, the recording medium is repeatedly used. This allows a streamlined procedure for setting the operating conditions for the control unit.

BRIEF DESCRIPTION OF DRAWINGS

FIG. 2 is a block diagram, providing an example of the arithmetic unit.

FIG. 5 is a block diagram of a second embodiment of the arithmetic unit.

FIG. 12 is the front view of an example of the display screen on the display unit.

THE BEST-PREFERRED EMBODIMENT OF THE PRESENT INVENTION

Figure 1:
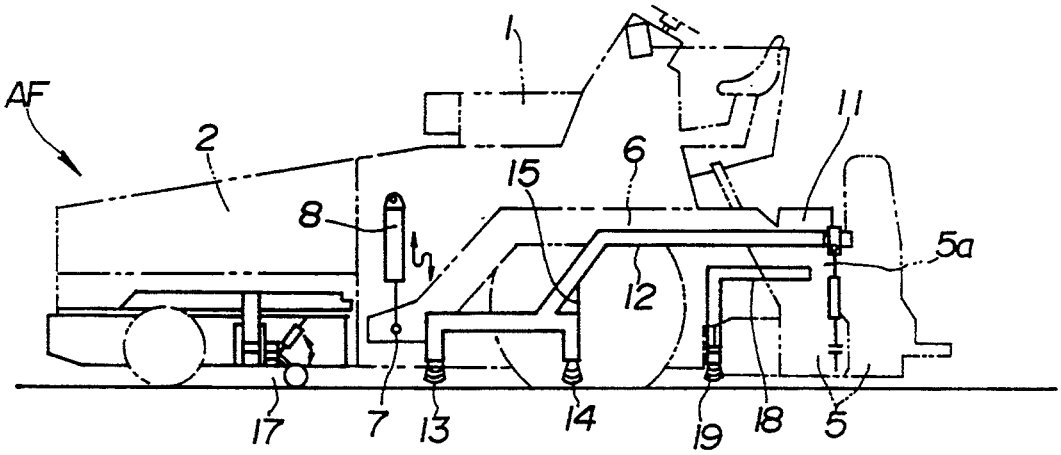
FIG. 1 is a side view of the asphalt finisher embodied in the present invention.
Figure 3:
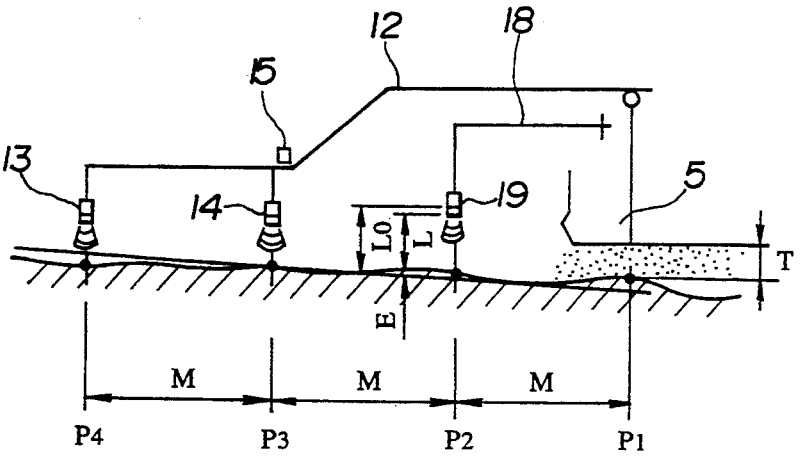
FIG. 3 is an explanatory drawing of the first and second embodiments.
Figure 4A:
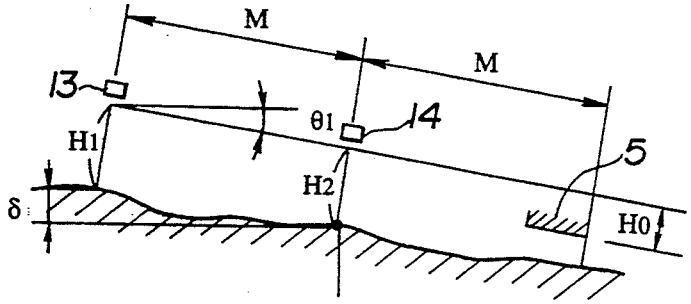
FIGS. 4 (A) and (B) are explanatory drawings for determining the thickness of pavement over the base course.
Figure 4B:
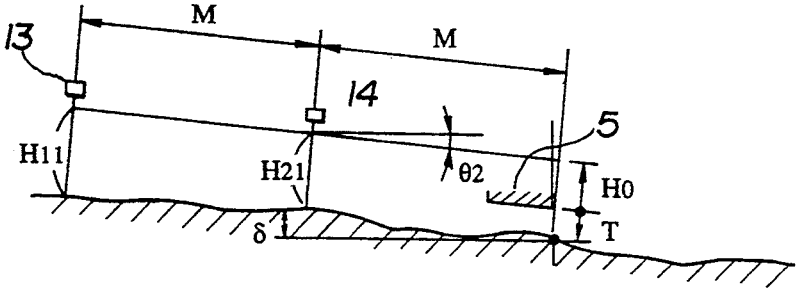

FIGS. 1 to 4 show an embodiment of the present invention applied to an asphalt finisher. The numeral (1) in FIG. 1 shows the tractor unit for the asphalt finisher AF. On the front of the tractor unit, a hopper (2) is provided to carry the mixed asphalt material. Mixed asphalt material in the hopper (2) is sent to the rear (to the right of FIG. 1) by a feeder at the bottom of the tractor unit body, then is spread by a screw uniformly to the left and right, and leveled by a pair of screeds (5) on the left and right sides of the tractor unit.

The screed (5) is supported by a supporting pin (7), which is provided at approximately the center of the side sections of the tractor unit (1) via a leveling arm (6). The supporting pin (7) is moved up and down by a pivot cylinder (8). The basic structure of the asphalt finisher AF is well known.

The symbol (11) shows the measuring units, one is provided on the left, and one on the right side of the tractor unit. The measuring unit (11) consists of a first height sensor (13) at the end of the measuring arm (12), a second height sensor (14) at the center of the measuring arm (12), which acts as a mate sensor to the first sensor (13), and a tilt sensor (15) to measure the tilting angle of the measuring arm (12). The base end of the measuring arm (12) (the center of FIG. 1) is pin-supported by a frame **(5*a*) which supports the screed (5). With this pin-support, the measuring arm (12) tilts while duplicating the movement of the screed (5)**.

Figure 8:
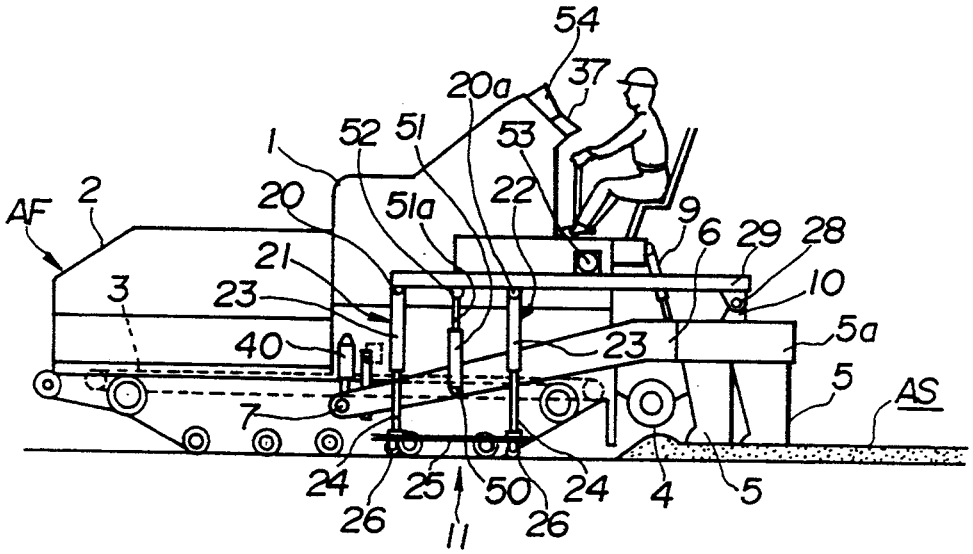
FIG. 8 is a side view of an example of the leveling machine in the third embodiment.

Several types of first sensors (13) and the second sensors (14) are possible. The present example uses sensors which utilize ultrasonic waves. As shown in FIG. 8, the distance between the sensors (13) and (14) is set to $\frac{1}{2}$ (or any other whole number fractions) of the distance between the second sensor (14) and the rear edge of the screed (5). The relative height of the sensors (13) and (14) to the screed (5) is set at a value which remains constant, regardless of the tilt angles for both the screed (5) and measuring arm 12. (see FIG. 4)

The symbol (17) shows a distance sensor for the travel distance calculation.

The symbol (18) shows an L-shaped arm attached so that it can move up/down together with the screed (5). The base end (to the right of FIG. 1) of the arm (18) is fixed to the frame **(5*a*) supporting the screed (5), and the front end of the arm (18) is provided with a third height sensor (19) to measure the distance to the road surface. The third height sensor (19) is located between the second height sensor (14) and the rear edge of the screed (5). Consequently, the same distance M is provided between the rear edge of the screed (5) and the third height sensor (19), between the third height sensor (19) and the second height sensor (14), and between the second height sensor (14) and the first height sensor (13). The third height sensor (19) uses an ultrasonic wave sensor in the same manner as the first sensor (13) and the second height sensor (14)**.

The arithmetic unit (30) is connected to the first height sensor (13), the second height sensor (14), the tilt sensor (15), and the distance sensor (17). The arithmetic unit (40) is connected to the third height sensor (19) (see FIG. 2).

The arithmetic unit (30) consists of an A/D (Analog to Digital) converter (31) which receives an analog output from the height sensors (13) and (14) and the tilt sensor (15), and converts this analog output to a digital output, an I/O (Input/Output) interface (32) which receives an individual output from the A/D converter (31), and a distance sensor (17), an operation unit (33), which performs operations based on data from the I/O interface (32), and a data storage unit (34) which receives and stores values obtained by the operation unit (33) and outputs those values from the storage part (34) to the operation units (33).

The arithmetic unit (40) consists of an A/D converter (41), which receives an analog output from the third height sensor (19) and converts it to a digital output, an I/O interface (42), which receives a digital output from the A/D converter (41), an operation unit (43), which is electrically connected to the operation unit (33) and which performs operations based on data from the I/O interface (42), and an I/O interface (44) which provides data processing for values obtained from the operation unit (43).

A signal output from the I/O interface (44) is sent to a solenoid valve (46) inserted in the hydraulic circuit (which is not Illustrated) to operate that solenoid valve (46), so that the pivot cylinder (8) will either extend or retract.

The arithmetic unit (30) performs the specified operation based on the measurement signal sent from the height sensors (13) and (14) when the tractor unit (1) travels over a distance equal to the spacing between the height sensors (13) and (14). The arithmetic unit (40) always performs the specified computing whenever the tractor unit (1) is travelling.

The details of the operation conducted by the operation unit (33) are (1) to calculate the thickness of pavement T from the difference between the levels at two measurement points simultaneously measured by a pair of height sensors (13) and (14), (2) to choose multiple continuous points from the calculated thickness of pavement T and calculate the average value Ta of the thickness of pavement T, and (3) to calculate the difference $\epsilon$ between the calculated average value Ta of the thickness of pavement T and the target thickness of pavement To.

The details of the operation conducted by the operation unit (43) are (1) to calculate the target control value Lo measured by the third height sensor (19) based on data obtained when the operation of the asphalt finisher. AF is steady, and calculate the amount of action required in the pivot cylinder (8) for controlling the screed based on the calculated target value Lo, (2) to calculate the difference E between the value measured by the third height sensor (19) and the object control value Lo, and (3) to provide an appropriate correction for the target control value Lo measured by the third height sensor (19) when the difference $\epsilon$ between the object thickness of pavement To and the actual average thickness of pavement Ta exceeds a certain range.

When the measured value L, which is measured by the third height sensor (19) deviates from the target control value Lo, the screed (5) is controlled in order to correct the differnce between these two values. This control is based on the data previously stored in memory of the operation part in accordance with the different types of experiments.

The following paragraphs describe a method for calculating the differences between the levels $\delta_1$, $\delta_2$, $\delta_3$ and so on at two measurement points $P_1$ and $P_2$, $P_3$ and $P_4$, and so on, simultaneously measured by the pair of height sensors (13) and (14). The following paragraphs in reference to FIGS. 3 and 4 also describe a method for calculating the thickness of pavement T at each of the measurement points $P_1$, $P_2$, and so on.

The height difference $\delta$ can be calculated by the following equation.

$$\delta = H_2 - (H_1 - M\tan\theta_1) \quad (1)$$

where the symbols in the equation above have the following meaning:

$H_1$: Value detected by the first height sensor (13)

$H_2$: Value detected by the second height sensor (14)

M: Distance between the first and second sensors (13) and (14)

$\theta_1$: Tilt of the measuring arm (12)

Based on the difference between the levels $\delta$ above, the thickness of pavement T can be calculated by using the following equation.

$$T = H_{21} + \delta - M\tan\theta_2 - H_0 \quad (2)$$

where the symbols in the equation above have the following meaning:

$H_{21}$: Value detected by the second height sensor (14)

$\delta$: Value calculated by the equation (1) above

M: Same as above $\theta_2$: Tilt of the measuring arm (12)

$H_0$: Difference between the levels of the height sensor (14) and the screed (5)

The equations (1) and (2) above are provided for an easier understanding of the method used to calculate the level difference $\delta$ and the thickness of pavement T. The method differs slightly from those used by the measuring unit (11) of by the asphalt finisher AF in FIGS. 1 and 3. To actually take a measurement with the measuring unit (11), the thickness of pavement T is calculated after the tractor unit (1) travels over the distance equal to the spacing M between the height sensors (13) and (14), rather than the distance 2M between the screed (5) and the second height sensor (14).

In the equations (1) and (2) above, the height difference $\delta$ and the thickness of pavement T does not take the tilt $\theta$ into consideration. Therefore, the values in the equations are slightly different from the actual values. Nonetheless, such a difference is negligibly small in practice.

The following paragraphs describe a method for controlling the thickness of the pavement with the leveling machine in the configuration already described.

The asphalt finisher AF begins by sending a mixed asphalt material in the hopper (2) to the screw through the feeder, while the tractor unit (1) travels at a constant speed as in the conventional system. This material is then uniformly spread in front of the screed (5) which levels the material.

In the operation above, the distance covered by the tractor unit (1) is measured by the distance sensor (17), and, when the travel distance reaches M, the first height sensor (13) and the second height sensor (14) measure the distance to the base course surface. This measurement result is then forwarded to the arithmetic unit (30).

The arithmetic unit (30) calculates the thickness of pavement T on the basis of the output signals from the height sensors (13) and (14), the distance sensor (17), and the tilt sensor (15), as described above. On the basis of this calculated pavement thickness, the arithmetic unit (30) also derives the average value Ta of the pavement thickness at multiple continuous measurement points on the paved surface, determining the difference $\epsilon$ between the average value and the preset target thickness of pavement. The determined value is then forwarded to the arithmetic unit (40). Data is sent to the arithmetic unit (40) when the tractor unit travels over a specified distance (for example, 5 m) or at specified time intervals.

While the tractor unit (1) is travelling, the distance to the base course surface at the distance M in front of the screed (5) is constantly measured by the third height sensor (19), and this measured value is relayed to the arithmetic unit (40).

The arithmetic unit (40) determines the difference between the value L measured by the third height sensor (19) which has been sent to the arithmetic unit (40) and the predetermined target control value Lo, and, based on that difference, the arithmetic unit (40) determines how to control the pivot cylinder. The target control value Lo can be obtained when the operator specifically presses the specified switch during the initial operation of the asphalt finisher after the operator Judges that the operation is steady.

The control signal for the pivot cylinder described above is sent to the solenoid valve (46) via the I/O interface (44) to extend or retract the pivot cylinder (8), which controls the screed accordingly (5).

This enables the screed (5) to be controlled, while taking into account the unevenness of the base course, so that the flatness of the finished pavement surface will be ensured. In other words, careful grading control can be achieved.

When the tractor unit has travelled over the specified distance (for example, 5 m), it is determined, based on the signal sent from the operation unit (33), whether or not the average value Ta of the actual thickness of the pavement is greatly different from the target thickness of the pavement To. If this difference is outside a certain range, the constant Lo is adjusted to an appropriate value.

This technology ensures flatness for the asphalt finisher, which is an embodiment of the present invention. In addition, if the pavement thickness differs from the target thickness of the pavement, the pavement thickness can be corrected to a value close to the target thickness of the pavement.

FIG. 5 shows another arithmetic unit. This arithmetic unit (30) consists of an A/D converter (31) which receives an analog output from the height sensors (13) and (14) and the tilt sensor (15), and converts this output to a digital output, an I/O interface (32) which individually receives the digital signals from the A/D converter (31) and the distance sensor (17), a (33) which performs operations based on data from the I/O interface (32), a data storage unit (34) which receives and stores values obtained in the operation unit (33) and outputs such values to the operation unit (33), and an I/O interface (35) which provides data processing for values calculated by the operation unit (33). A signal output from the I/O interface (35) is then sent to the solenoid valve (36) which adjusts the pivot cylinder (8) by either extending or retracting it.

The arithmetic unit (30) performs the specified operations on the basis of the measurement signals received from the height sensors (13) and (14). The signals are measured when the tractor unit (1) travels over a distance equal to the space between the height sensors (13) and (14).

Figure 6A:
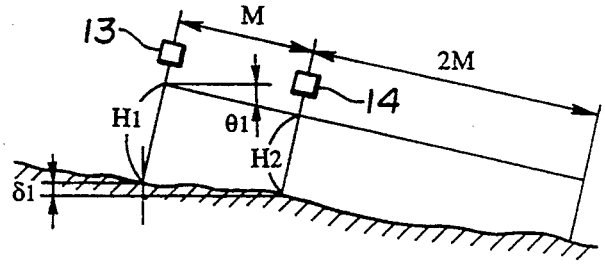
FIGS. 6 (A), (B), and (C) explanatory drawings for determining the difference between the level of the base course and the thickness of the pavement.
Figure 6B:
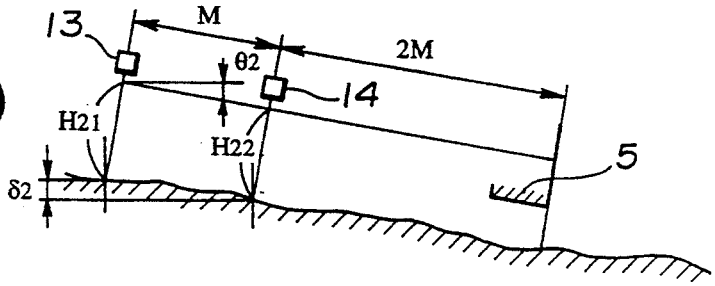
Figure 6C:
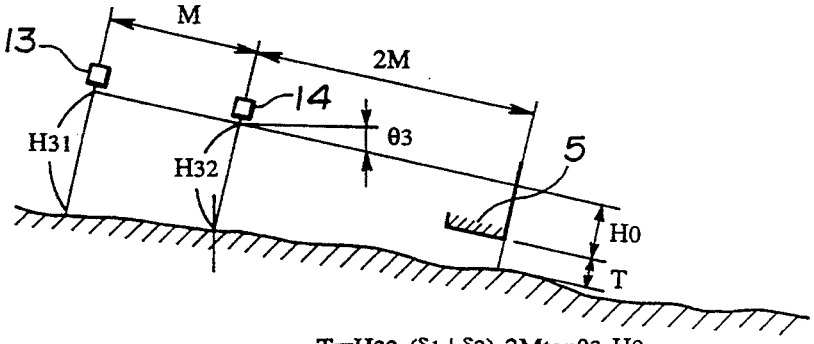
Figure 7:
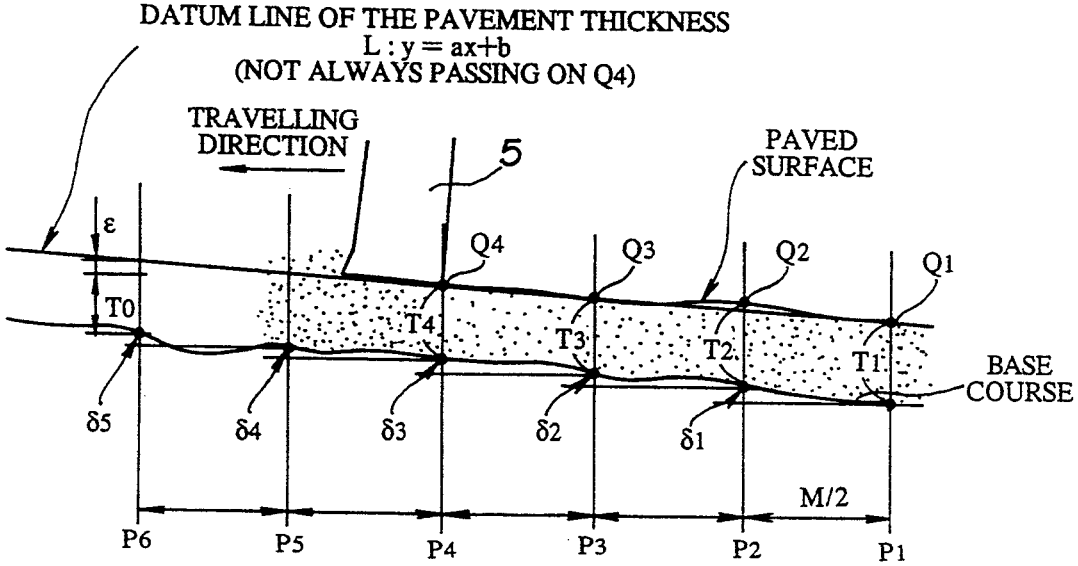
FIG. 7 is an explanatory drawing of the second embodiment.

The main contents of the operation of the arithmetic unit (30) are (1) to calculate the level differences $\delta_1$ $\delta_2$ etc., at two measurement points $P_1$ and $P_2$, $P_3$ and $P_4$, etc., simultaneously measured by a pair of height sensors (13) and (14) (see FIGS. 6 and 7), and also calculate the thickness of the pavement $T_1$, $T_2$, etc., at the measurement points $P_1$, $P_2$, etc., (2) to achieve the coordinates from the measurement points $Q_1$, $Q_2$, $Q_3$, $Q_4$, etc., on the paved surface obtained during the measurement of the thickness of the pavement $T_1$, $T_2$, etc., and determine the datum line of the thickness of pavement (1) ($y=ax+b$) by introducing, for example, the least squares method, and (3) to determine the position of the target thickness of the pavement of the target point at the specified distance beyond the screed (5) and calculate the required amount L of the pivot cylinder to adjust the position of the screed (5) and thereby eliminate the difference between the target height of the pavement and the datum line of the thickness of the pavement (1).

At this time, the tilt of the screed (5), the nature and feeding of the mixed asphalt material, and the tractor unit travelling speed must be taken into account, since these factors may affect the thickness of the pavement.

The command signal for the amount of operation L of the pivot cylinder (8) calculated above is sent to the solenoid valve (36) Integrated into the hydraulic circuit, which is not illustrated. As the solenoid valve (36) is operated, the pivot cylinder (8) either extends or retracts.

The method for calculating the difference between the levels $\delta_1$, $\delta_2$, etc., at two measurement points $P_1$ and $P_2$, $P_2$ and $P_3$, $P_3$ and $P_4$, etc., simultaneously measured by a pair of height sensors (13) and (14), and the method for calculating the thickness of pavement $T_1$, $T_2$, etc., at the measurement points $P_1$, $P_2$, etc., have been described above (see the equations (1) and (2)).

This arithmetic unit (30) also calculates the level difference $\delta$ and the thickness of the pavement T, from the output signal sent from the height sensors (13) and (14), the distance sensor (17), and the tilt sensor (15) as described above. Then, on the basis of the values calculated, the arithmetic unit (30) calculates the datum line .of the pavement thickness (1) : $y=ax+b$ which is derived from, for example, the newest points on the paved surface (four points, $Q_1$, $Q_2$, $Q_3$, and $Q_4$, in FIG. 7).

Then, the thickness of pavement at the target point at distance M (xN integers) ahead of the screed (5) is calculated from the level difference $\delta_4$ and $\delta_5$ and the ideal thickness of the pavement To, and the required amount of the movement of the pivot cylinder to change the position of the screed (5) to eliminate the discrepancy between the datum line and the target point, is determined.

This calculated value is sent to the solenoid valve (36) via the I/O interface (35) to extend or retract the pivot cylinder (8).

The operation described above is repeated whenever the tractor unit (1) travels over the distance M. The screed (5) is controlled so as to obtain the ideal thickness of the pavement at the point M distance ahead.

FIGS. 8 to 12 show another embodiment of the asphalt finisher of the present invention. The numeral (1) represents the tractor unit of an asphalt finisher AF. This tractor unit (1) is a crawler type, and is provided with a hopper (2) which contains a mixed asphalt material As, a feeder (3) which sends the mixed asphalt material from the hopper (2) to the rear (to the right of FIG. 1), a screw (4) which uniformly spreads the mixed asphalt material As sent from the feeder (3) to the left and right, and a screed (5) levels the mixed asphalt material As which has been spread by the screw (4). The screed is suspended on the leveling arms (6) and (6) (only the leveling arm on the left side is shown in FIG. 8) via the frame (5a). A leveling arm (6) is mounted on each side of the tractor unit (1), so that it can swivel up and down around the supporting pin (7). The base end of the rod of a pair of the left and right screed cylinders (9) is attached to the top of the rear end of the tractor unit (1) so that it can freely rotate, and the lower end of the rod is attached to the read end of each leveling arm (6) so that it can freely rotate. By operating the screed cylinders (9), screed (5) can be moved up and down around the supporting pin (7). In this case, the basic structure of the asphalt finisher AF is also well known.

The symbol (11) represents the measuring unit. The measuring unit (11) consists of a basic member (29) which can freely rotate within a perpendicular plane in the travelling direction while the rear end is pivoted with a supporting pin (28) to a supporting member (10) fixed to the top of a frame (5a), a hydraulic cylinder (51) which is pivoted to a mounting member (50) fixed to a leveling arm (6) and also pivoted to a mounting member (52) whose piston rod is fixed to the basic member, a slope sensor (53) installed on the top of the basic member (29) which detects the slope of that basic member (29) and sends a control signal to the control valve (not illustrated) of the hydraulic cylinder (51), and a first height sensor (the height above the road detector) (21) and second height sensor (22) which are pivoted to mounting members (20) and (20a), respectively, and fixed to the basic member (29). The mounting member (20) is fixed to the front end of the basic member (29), and the other mounting member (20a) is provided at a point $\frac{1}{3}$ from the mounting member (20) of the distance between the mounting member (20) and the supporting pin (28). The supporting pin (28) is positioned midway of screed (5). The slope sensor (53) which measures the angle of the slope controls the basic member (29) so that the angle of slope remains zero (that is, the basic member remains horizontal).

Each of the height sensors (21) and (22) consists of a cylindrical member (23), a bar member (24), and a potentiometer (not illustrated). The cylindrical member (23) and the bar member (24) fit each other, and can freely extend or retract. The potentiometer converts the relative displacement of the cylindrical member (23) and the bar member (24) into an electrical signal.

Figure 9:
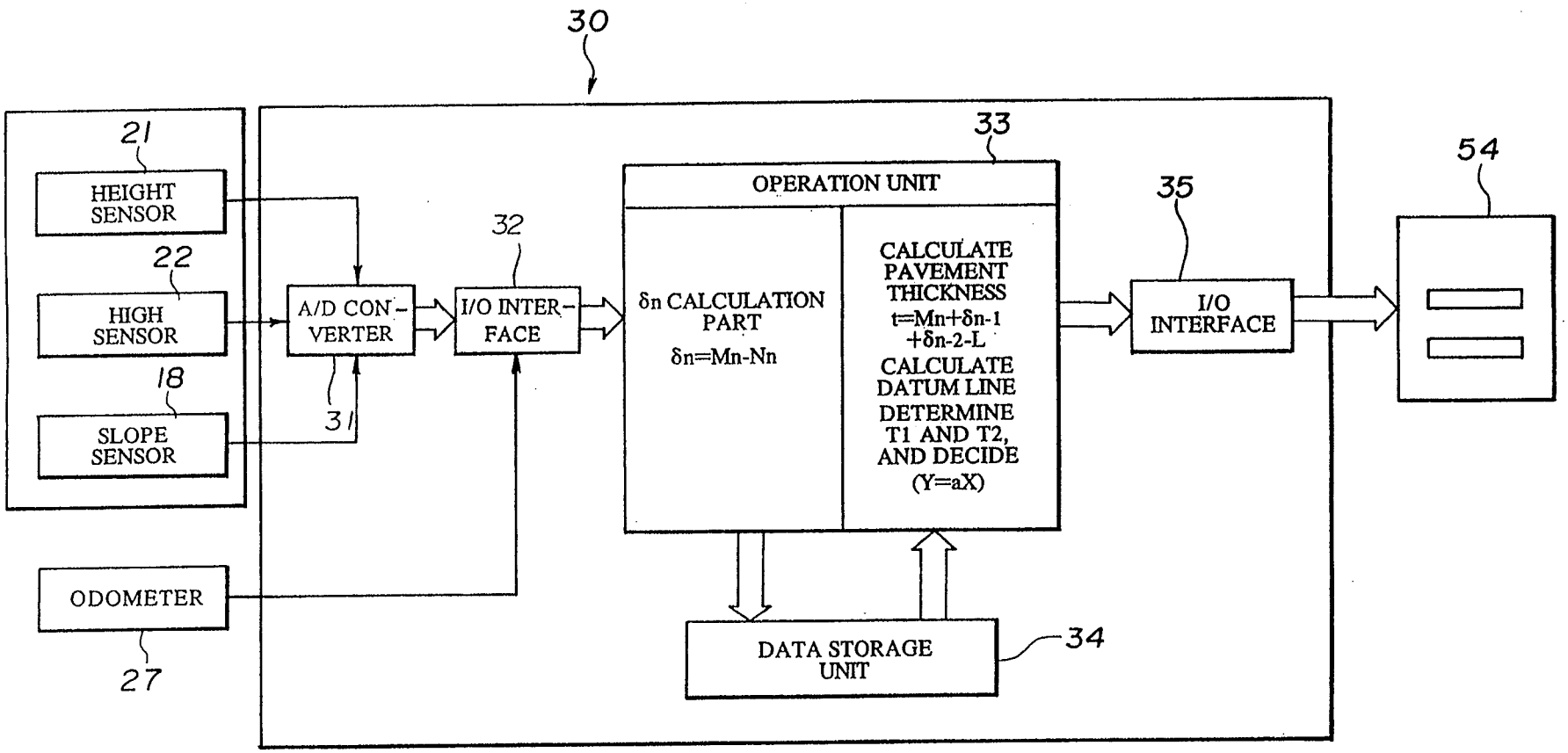
FIG. 9 is a block diagram, providing an example of the control unit.
Figure 10:
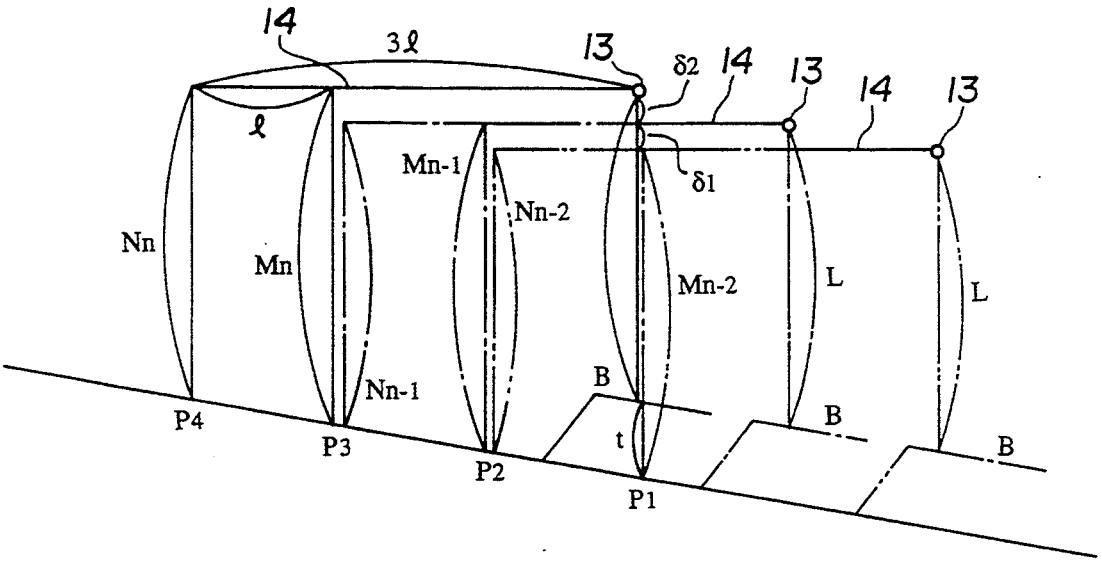
FIG. 10 is an explanatory drawing for illustrating the principle of the pavement thickness measurement by the leveling machine shown in FIG. 8.

The lower ends of the bar members (24) and (24) of the height sensors (21) and (22) are pivoted with a coupling member (25). The coupling member (25) is provided with wheels (26) on the bottom at each pivoting position of the bar members (24) and (24), and coupled to the tractor unit (1) with a coupling bar (not illustrated). The coupling member (25) is dragged by the tractor unit (1) to travel on the base course surface, and transmits information on the uneven levels of the base course surface to the height sensors (21) and (22). This tractor unit (1) is also provided with an odometer (27) (FIG. 9).

The height sensors (21) and (22) and the odometer (27) are connected to a control unit (arithmetic unit) (30). This control unit (30) consists of an A/D converter (31) which receives an analog output from the height sensors (21) and (22) and converts this analog output into a digital output, an I/O interface (32) which receives a digital output from the A/D converter (31) and the odometer (27), an operation unit (33) which performs operations based on data received from the I/O interface (32), a data storage unit (34) which receives and stores values obtained by the operation unit (33) and outputs data to the operation unit, an I/O interface (35) which provides data processing to send these values to a display unit (54) installed at the operator's seat of the tractor unit (1) or at any appropriate place, and an input part which inputs the initial operating conditions of the pavement.

The control unit (30) performs the specified operations based on the measurement signals received from the height sensors (21) and (22). The signals are measured when the tractor unit (1) travels over a distance (1) which is $\frac{1}{3}$ of the length (31) between the mounting member (20) and the supporting pin (28) attached to the basic member (29). If the base course surface has a slope at an angle $\theta$, it is recommended that the covered distance for the calculation of the tractor unit (1) be taken to be $1\sec\theta$.

The primary operation of the control unit (30) is to calculate the difference between the levels at two measurement points, $P_1$ and $P_2$, $P_2$ and $P_3$, etc., simultaneously measured by a pair of height sensors (21) and (22) in order to calculate the thickness of pavement t at the position of the supporting pin (28) which is the reference point ($P_1$ in FIG. 10), and to determine the datum line of the pavement from one of the lines $T_1$, $T_2$, and $T_3$ which connect the point $P_1'$ by "t" above the measurement point P1 at the reference point position and the points $P_2'$, $P_3'$, and $P_4'$ by "t*" (the target thickness of the pavement) above the measurement points $P_2$, $P_3$, and $P_4$ in front of (to the left in FIGS. 10 and 11) of the measurement point $P_1$, or one line derived through the arithmetic processing by, for example the averaging of such multiple lines.

When the result of the n-th measurement by the first height sensor (21) is Nn, the result of the n-th measurement by the second height sensor (22) is Mn, the results of the measurement before the (n−1) measurement, that is, the (n−1)th measurements by the first and second height sensors (21) and (22) are $N_{n-1}$ and $M_{n-1}$, respectively, and the results of the (n−2)th measurements by the first and second height sensors (21) and (22) are $N_{n-1}$ and $M_{n-1}$, respectively. Moreover, the level difference can be calculated by the following equations (3), (4), and (5): nth measurement $$\text{(n) measurement: } M_n - N_n \tag{3}$$

$$\text{(n-1)th measurement: } M_{n-1} - N_{n-1} \tag{4}$$

$$\text{(n-2)th measurement: } M_{n-2} - N_{n-2} \tag{5}$$

The thickness of pavement t can be calculated by the equation (6).

$$t = M_n + (M_{n-2} - N_{n-2}) + (M_{n-1} - N_{n-1}) - L \tag{6}$$

where the value $(M_{n-2} - N_{n-2})$ is the level difference at $P_1$ and $P_2$, that is, $\delta_1$. The value $(M_{n-1} - N_{n-1})$ is the level difference at $P_2$ and $P_3$, that is, $\delta_2$. The value L is the height from the bottom of the screed (5) to the basic member (29). This value remains constant.

Figure 11:
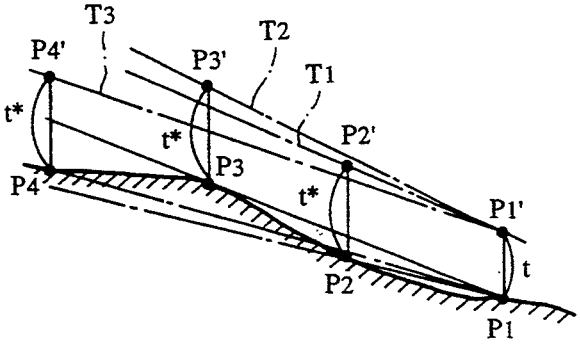
FIG. 11 is an explanatory drawing of the reference line for the thickness of the pavement.

When there is only one measurement point ($P_1$) other than the reference measurement point ($P_2$), for example, in FIG. 11, the control unit (30) determines the datum line to be the line $T_1$ which connects the point $P_1'$ by "t" above the point $P_1$ to the point $P_2'$ by "t*" above the point $P_2$. When there is more than one measurement point other than the reference measurement point, the control unit (30) determines the datum line of the thickness of pavement to be the highest one $T_2$ of the lines $T_2$, $T_2$, and $T_3$, which connect the point $P_1'$ by "t" above the reference measurement point $P_1$ to the points $P_2'$, $P_3'$, and $P_4'$ by "t*" above the measurement points $P_2$, $P_3$, and $P_4$, respectively.

The results above are used to control the amount of supply of mixed asphalt material As received by the feeder (3), the angle of attack of the screed (5) generated by the pivot cylinder (40), and the speed of the tractor unit (1), so that screed (5) will move along the datum line of the thickness of pavement $T_1$ or $T_2$ for the pavement.

There are several types of leveling machines; a machine which uses wheels instead of crawlers, a machine with ultrasonic or laser height sensors (21), (22), etc. The detailed structures of such machines depend on individual application.

In the present invention, the target thickness of the pavement t* is input into the IC card as an initial pavement condition, which is then entered into the control unit (30) by inserting the IC card into the input part (37). The target thickness of the pavement t* includes the left target thickness of the pavement and the right target thickness of the pavement. This thickness may be set to any value, for example 50 mm or 70 mm. Besides the target thickness of the pavement, the following initial pavement conditions are also entered into the IC card. The setting items and the contents are as follows:

Selecting a method to control the thickness of the pavement
Priority control of the thickness of pavement
Priority control of the flatness
Control of the side level
Control of the cross slope
Others
Selecting the type of mixed material
Coarse-graded asphalt concrete (20)
Dense-graded asphalt concrete (20)
Dense-graded asphalt concrete (13)
Fine-graded asphalt concrete (13)
Dense-graded gap asphalt concrete (13)
Others
Determining the width of the pavement
The width of the pavement can be set corresponding to the width of the road, for example 4.5 m, 4.0 m, or 3.5 m.
Setting the planned length of the pavement The length of pavement can be set to, for example, 500 m or 300 m.
Setting the density of the mixed material
The density can be set to, for example, 2.40 t/m$^3$.
Setting the planned working speed
The speed can be set to, for example, 3.0 m/min.

The initial paving conditions are usually written onto the IC card at the office. The IC card containing these initial conditions is delivered to the operator, who then inserts the IC card into the input slot (37) of the operation board. When the IC card is inserted in the input slot (37), the settings of the IC card are displayed on the Initial Conditions Setting screen (38) (FIG. 12) of the display unit (54). The operator can, therefore, confirm the initial conditions from the display on the Initial Conditions Setting screen (38) before starting the paving work.

When the paving work is finished, the operator removes the IC card from the input slot (37) and returns it to the office.

If the IC card containing the initial paving conditions for the road to be paved is not provided, or part of the initial paving conditions contained in the IC card have to be modified, the operator should type the required initial paving conditions into the control unit (30) from the keyboard (not illustrated) near the input slot (37) or at the control panel (54) to make any required modifications.

The IC card stores the date and time, name of the mixed asphalt material, changes in the thickness of the pavement, width of the pavement, covered distance, amount of mixed material used, and any other required operation data. After the pavement work has been finished, the IC card is removed from the machine, and is used to manage the pavement construction.

Either automatic control by the thickness datum line, or the automatic control by the initial operating conditions set in the IC card, may be selected In accordance with the contents. Also, both controls can be used together for automatic operation. The thickness datum line is displayed on the other screens of the display unit (36).

Examined samples and technical items other than those described above are as follows: (1) The embodiment samples mentioned above set the distance between the height sensors (18) and (14) as "M". However, this distance may be 2M, M/2, or M/3. Using the distance, M/2 or M/3, may enable the measuring unit (11) to be more compact. (2) The height sensors (13), (14), and (19) need not necessarily be the ultranonic type. They may also be the laser type, or the telescopic type, such as the height sensors (21) and (22) in FIG. 8. The specific structure of the sensors is optional. (3) The embodiment samples mentioned above determine the thickness datum line through the least squares method by using the four newest points after pavement. Instead of these four points, the three or five newest points may also be used to calculate the datum line.

INDUSTRIAL FEASIBILITY

Since the present invention ensures the flatness of the paved surface, without using any special devices such as the averaging beam described in the section summarizing the "conventional technology", and controls the tilting angle of the screed, feeding back any difference between the actual thickness of the pavement calculated from data from a pair of the height sensors and the target thickness of pavement, the present invention is very effective in ensuring that the thickness of the pavement will be very close to the desired value.

In addition, the present invention enables the thickness of the pavement and other operating conditions to be set quickly and accurately.

What is claimed is:

1. A pavement thickness control apparatus for controlling pavement thickness for use in a spreading machine comprising:

a traveling tractor unit having means for traveling over an unpaved road surface while supplying asphalt material to said unpaved road surface;

a screed for paving said unpaved road surface by evenly spreading said asphalt material, said screed having a lower edge for defining an upper surface of said pavement;

and a positioning means for determining a position of said lower edge of said screed in order to control said pavement thickness;

wherein said pavement thickness control apparatus comprises:

a plurality of measuring means for measuring vertical distances therefrom to said unpaved road surface, said measuring means disposed spaced apart from each other along said direction of travel of said tractor;

an inclination measuring means for measuring inclination of coordinates fixed to said plurality of measuring means, said inclination being resultant from an unevenness of said unpaved road surface;

wherein said position of said lower edge of said screed is determined, to compensate for said unevenness of said unpaved road surface, by taking into account said inclination of coordinates fixed to said plurality of measuring means.

2. A pavement thickness control apparatus according to claim 1, wherein said screed is pivotably supported about a horizontal axis perpendicular to said direction of traveling of said tractor unit so that said lower edge is vertically positioned as the screed pivots about said horizontal axis.

3. A pavement thickness control apparatus according to claim 1, wherein said pavement thickness control apparatus has two measuring means and said positioning means determines the position of said screed each time said tractor proceeds a predetermined distance.

4. A pavement thickness control apparatus according to claim 1, wherein said pavement thickness control apparatus further comprises means for storing a target pavement thickness and the position of said screed is adjusted with reference to said target pavement thickness and an actual thickness of said pavement.

5. A pavement thickness control apparatus according to claim 1, wherein said positioning means comprises a control unit for obtaining the position of said screed according to the unevenness of said unpaved road surface measured by said plurality of measuring means.

* * * * *

UNITED STATES PATENT AND TRADEMARK OFFICE

CERTIFICATE OF CORRECTION

PATENT NO. : 5,393,167

DATED : February 28, 1995

INVENTOR(S) : Fujita et al

It is certified that error appears in the above-indentified patent and that said Letters Patent is hereby corrected as shown below:

On the title page: Item [63] should read as follows:
Related U. S. Application Data [63] Continuations of Ser. No. 838,720, filed Oct. 18, 1993, now abandoned, which was the national stage of international application number PCT/JP91/01560, filed Nov. 14, 1991. --.

Signed and Sealed this

Eighth Day of August, 1995

Bruce Lehman

*Attest:*

BRUCE LEHMAN

*Attesting Officer*

*Commissioner of Patents and Trademarks*